US006862854B1

(12) United States Patent
Fitzmyers

(10) Patent No.: US 6,862,854 B1
(45) Date of Patent: Mar. 8, 2005

(54) SINGLE-PIECE CONTINUITY TIE

(75) Inventor: Thomas J. Fitzmyers, Pleasanton, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/638,453

(22) Filed: Aug. 14, 2000

(51) Int. Cl.[7] ..... E04G 23/00

(52) U.S. Cl. ..... 52/291; 52/223.8; 52/223.11; 52/655.1; 52/696; 52/703; 52/712; 248/499; 403/219

(58) Field of Search ..... 52/281, 291, 223.1, 52/223.9, 223.11, 703, 706, 712, 655.1, 698, 223.8, 643, 654.1, 264, 696; 248/354.6, 354.3, 351, 499; 403/170, 176, 212, 218, 219; 240/505

(56) References Cited

U.S. PATENT DOCUMENTS

| | | | |
|---|---|---|---|
| 371,576 | A | 10/1887 | Haines |
| 436,767 | A | 9/1890 | Baker |
| 2,625,815 | A | 1/1953 | Black |

(List continued on next page.)

FOREIGN PATENT DOCUMENTS

| | | | |
|---|---|---|---|
| GB | 2139663 | B | 11/1984 |

OTHER PUBLICATIONS

Tanaka Steel Catalog, Tanaka Co., Ltd, Japan, published Jul. 1996, pp. 22–27, 41, 56, 58, 60, title and end page (12 pgs).
Tanaka Steel Catalog, Tanaka Co., Ltd., Japan, published Jun. 1997, p. 28, title and end page (3pgs).
Tanaka Steel Catalog, Tanaka Co., Ltd., Japan, published Nov. 1998, pp. 26–32, 35, 51–54, 56, 76, 78, 79, 81, title and end page (19pgs).
Tanaka Steel Catalog, Tanaka Co., Ltd., Japan, published Nov. 1999, pp. 24–27, 38, 49–51, 76, 77, title and end page (12pgs).
Tanaka Steel Catalog, Tanaka Co. Ltd., Japan, published Jul. 2001, pp. 40, 45, 55–57, titled and end page (7pgs).
Tanaka Steel Catalog, Tanaka Co., Ltd., Japan, published Feb. 2002, pp. 42,43, title and end page (4pgs).
Simpson Strong–Tie Co., Inc., "Wood Construction Connectors," Catalog C–2000, Simpson Strong–Tie Co., Inc. (U.S.A.), p. 21, 99–103, 115, (1999).
Zone Four, "CT System Details," Purlin to Purlin, Zone Four (U.S.A.), p. 1 (Jul. 10, 1996).
Structural Hardware Specials. 1992. KC Metals Superspeed Connectors product catalog, p. 19. KC Metal Products, Inc., San Jose, Calif.
Angels and Straps. 2000. USP Lumber Connectors Full LIne Catalog, p. 95, United Steel Products Company, Montgomery, Minn.
AHCSTR Hinge Connector Straps. Advanced Connector Systems product catalog, p. 25. Advanced Connector Systems, Tempe, Ariz. Received in the offices of James R. Cypher, Dec. 22, 1997.

*Primary Examiner*—Carl D. Friedman
*Assistant Examiner*—Yvonne M. Horton
(74) *Attorney, Agent, or Firm*—James R. Cypher; Charles R. Cypher

(57) ABSTRACT

A one-piece connecting member is provided that bridges or spans a beam disposed between two aligned structural members. A tunnel is formed in the beam to receive a connecting member. The connecting member attaches directly to both of the opposed structural members by means of heavy fasteners without the need of intermediary brackets. The connecting member is formed to provide both compressive and tensile resistance, and can be formed from tube steel.

20 Claims, 3 Drawing Sheets

U.S. PATENT DOCUMENTS 3,648,425 A 3/1972 Bolton
3,861,104 A 1/1975 Bower
4,321,776 A 3/1982 Delight
4,441,286 A 4/1984 Skvaril
4,472,916 A 9/1984 Krebs
4,531,334 A 7/1985 Nylander et al.
4,665,672 A 5/1987 Commins et al.
4,744,191 A 5/1988 Fricker
5,085,026 A 2/1992 McGill et al.
5,177,927 A 1/1993 Goya et al.
5,214,900 A * 6/1993 Folkerts ..... 52/696
5,249,404 A 10/1993 Leek et al.
5,303,520 A 4/1994 Gozdziak
5,307,603 A 5/1994 Chiodo
5,412,920 A 5/1995 Hess
5,491,935 A 2/1996 Coxum
5,535,561 A * 7/1996 Schuyler ..... 52/223.13
5,551,200 A 9/1996 Krug
5,606,837 A 3/1997 Holizander
5,678,375 A 10/1997 Juola
5,809,719 A 9/1998 Ashton et al.
5,813,181 A 9/1998 Ashton et al.
5,881,514 A * 3/1999 Pryor ..... 52/223.8
5,921,042 A 7/1999 Ashton et al.
5,992,126 A 11/1999 Ashton et al.
6,112,486 A * 9/2000 Ashton et al. ..... 52/291
6,155,019 A * 12/2000 Ashton et al. ..... 52/739.1
6,389,767 B1 5/2002 Lucey et al.
6,425,220 B1 7/2002 Ashton et al.

* cited by examiner

SINGLE-PIECE CONTINUITY TIE

BACKGROUND OF THE INVENTION

This invention relates to building construction in general, and specifically to an improved method of connecting two structural members which are part of a system for improving a building's response to lateral forces.

The purpose of a continuity system is to provide an engineered structural mechanism that transfers lateral loads across the building, typically through a roof or floor diaphragm. A continuity system generally consists of a plurality of spaced continuity lines that extend completely across both the length and width of a building. High winds and earthquakes are the two most common means of generating lateral forces in a building. In tilt-up buildings made with concrete wall panels, the lateral forces generated by the motion of the heavy walls during an earthquake creates very severe lateral loads on the structure.

Continuity ties can be separate members which are used to improve the connection between existing members of the structure to create a continuity system. In buildings with diaphragm roofs or floors, continuity systems often incorporate otherwise required structural members such as purlins or beams of the roof or floor into the continuity lines. Specially designed continuity ties are used to interconnect these otherwise required members. The present invention deals with such continuity ties.

Brackets called holdowns in combination with threaded rods have long been used in the industry as continuity ties. U.S. Pat. No. 5,249,404, granted to Alfred D. Commins and William F. Leek teaches using a pair of holdowns as part of a continuity tie. See U.S. Pat. No. 5,249,404, column 7, line 9. More recent examples of such brackets include U.S. Pat. Nos. 5,813,181 and 5,921,042, granted to Roger Wall Ashton, Robert Donald Lucey and John Duncan Pryor.

The above-mentioned patents are similar in how they form the particular continuity tie connection. A pair of aligned purlins to be connected are identified. Generally, the purlins will abut opposed sides of a beam. A first bracket is attached to a side of one of the purlins, and a second bracket is attached to the other purlin in alignment with the first bracket. A tunnel is then drilled through the beam in alignment with the brackets, and a bolt is run through the bore in the beam and attached to the two brackets by means of nuts, forming the connection between the two purlins. Depending on how the brackets are arranged and/or formed, these connections can resist both tension and compression forces.

The device of the present invention improves upon the connection made by the brackets of the prior art with a simpler design that is easier to install. Specifically, the device of the present invention does not require additional installation steps beyond those required to make a tension connection to also provide compression resistance.

SUMMARY OF THE INVENTION

The present invention provides a connection between a pair of structural members that is simple to construct.

The connection between the pair of structural member is designed to resist both tension and compression forces.

The connection of the present invention is designed to work in double-sided applications; that is, each structural member can have a pair of the connectors of the present invention secured to it. Preferably the pairs of connectors share the same bolts for attaching the connectors to the members.

The members that make up the means of connecting the pair of opposed structural members are simple to fabricate.

In the preferred embodiment of the present invention, an integral member is provided that bridges or spans a beam disposed between two structural members. The connecting member passes through a tunnel in the intervening beam between two structural members. The spanning member, itself, attaches directly to both of the opposed structural members by means of heavy fasteners without the need of intermediary brackets. Thus the preferred embodiment of the present invention is very rigid, and the opportunity for slip between components of the connection system is reduced.

DETAILED DESCRIPTION OF THE PREFERRED EMBODIMENTS

Figure 1A:
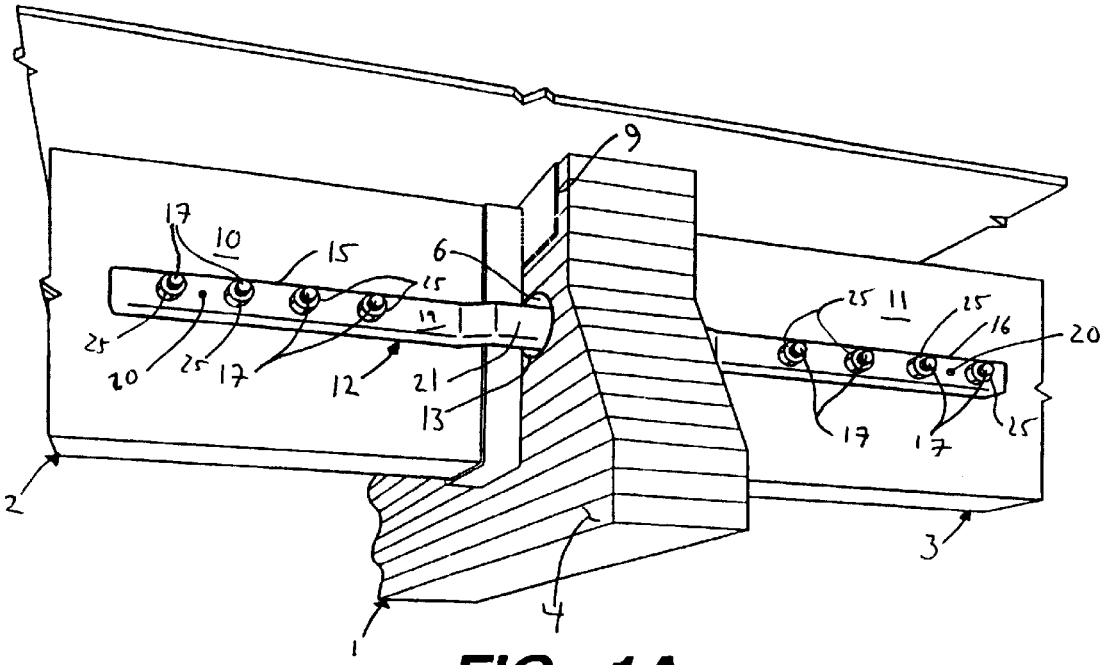
FIG. 1A is perspective view a connection formed according to the present invention. A first connecting member is shown joining a pair of second structural members. The second structural members are attached to the first structural member by hangers. The connecting member passes through a tunnel in the first member. Roof sheathing is shown applied to the first and second structural members and the intervening beam.
Figure 1B:
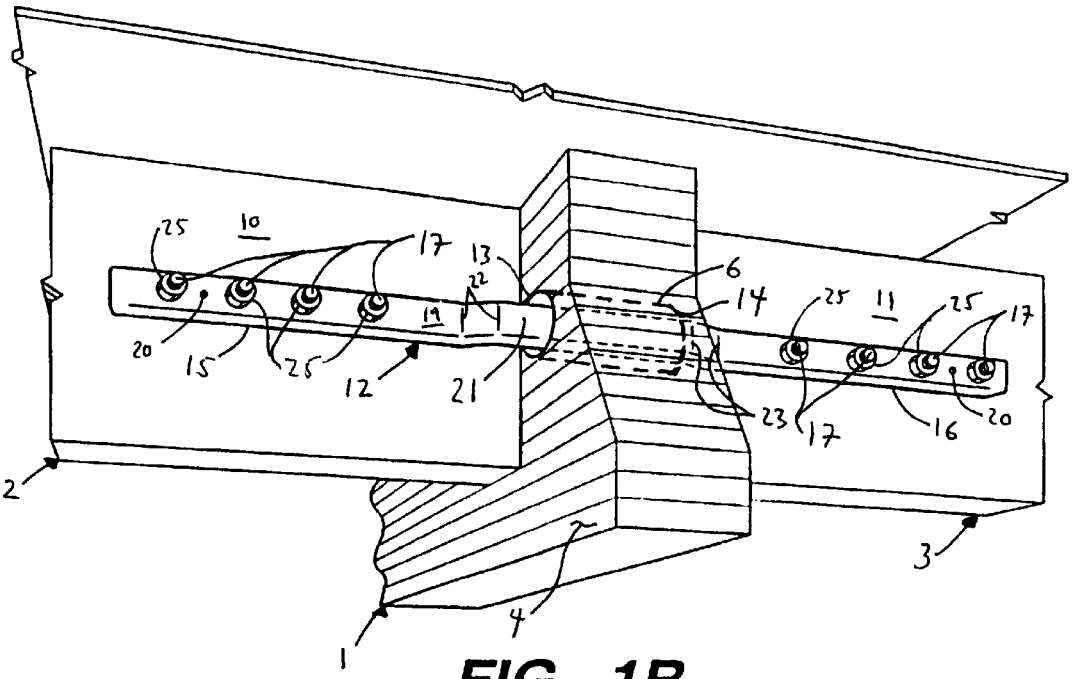
FIG. 1B is a similar view to FIG. 1A. The hangers have been removed to better show the tunnel through the first member. The central portion of the connecting member is shown in dotted lines.

As is shown in FIG. 1A, the present invention relates to a connection formed in a building between a first structural member 1 and a pair of second structural members 2 and 3.

Figure 6:
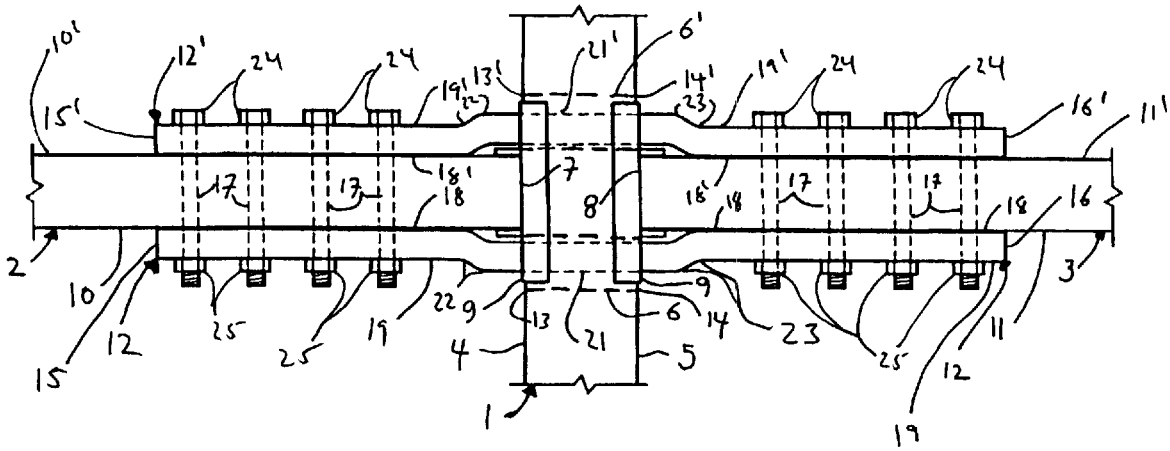
FIG. 6 is a plan view of the connection of the present invention.
Figure 3:
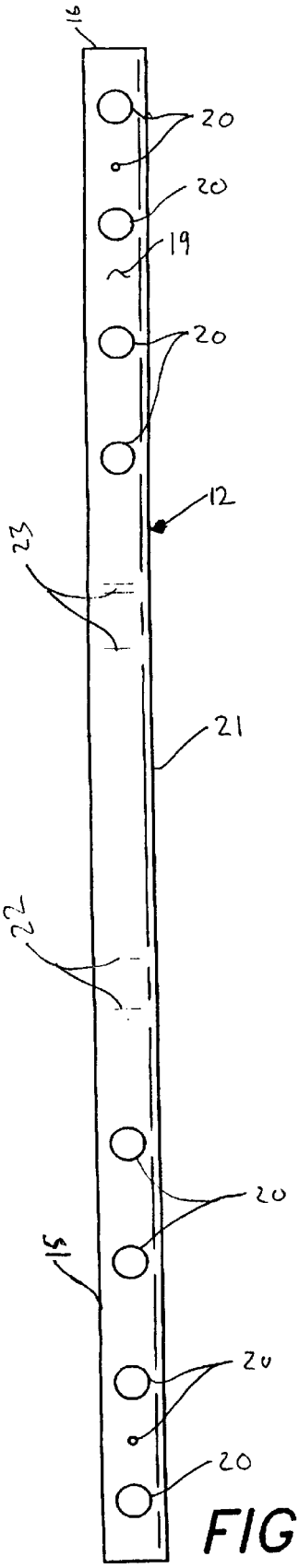
FIG. 3 is a plan view of the connecting member of the present invention.
Figure 4:
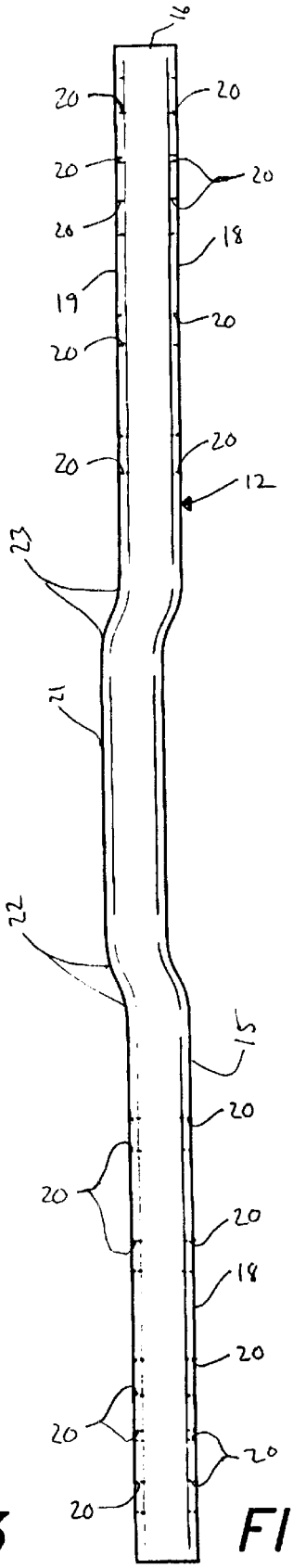
FIG. 4 is a side view of the connecting member of the present invention. The openings in the first and second walls of the connecting member are shown in phantom lines.
Figure 5:
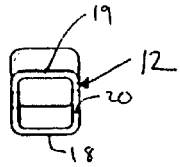
FIG. 5 is an end view of the connecting member of the present invention. Phantom lines show the larger openings in the first and second walls of the connecting member.

As is shown in FIG. 6, the first structural member 1 has a pair of opposing side faces 4 and 5, and a tunnel 6 is formed through the first structural member 1. Generally, the first structural member 1 will be formed as an elongated beam with a rectangular cross-section and the opposing side faces 4 and 5 will be the vertically disposed side faces of the beam.

Each of the pair of second structural members 2 and 3 has an end 7 or 8 substantially in abutment with one of the opposing side faces 4 and 5 of the first structural member 1. Preferably, each of the second structural members 2 and 3 is connected to the first structural member 1 by a hanger 9.

Each of the pair of second structural members 2 and 3 also has a first mounting surface 10 or 11, and these first mounting surfaces 10 and 11 are in general alignment. Generally, the second structural members 2 and 3 will be formed as elongated beams with rectangular cross-sections and these first mounting surfaces 10 and 11 will be one of the vertically disposed side faces of each of the beams.

Received within the tunnel 6 in the first structural member 1 is a first one-piece connecting member 12. This one-piece connecting member 12 extends through the tunnel 6 and passes out of the openings 13 and 14 in the first structural member 1 at the ends of the tunnel 6. These openings 13 and 14 are in the opposing side faces 4 and 5 of the first structural member 1. The one-piece connecting member 12 is formed with end portions 15 and 16, and it is these portions 15 and 16 that extend out of the tunnel 6. The end portions 15 and 16 of the connecting member 12 lie against the mounting surfaces 10 and 11 of the second structural members 2 and 3 and are attached to the second structural members 2 and 3 by fasteners 17.

Preferably, the one-piece connecting member 12 is formed as an elongated tube, with a substantially polygonal cross-section. Preferably, the polygonal tube is formed from four walls. One of these walls is designated the first wall 18, and each end portion has a first wall 18. The first walls 18 of the end portions 15 and 16 are in general alignment. Preferably, the first walls 18 of the end portions 15 and 16 are substantially planar and can register closely with the substantially planar mounting surfaces 10 and 11 of the second structural members 2 and 3.

Also in the preferred embodiment, each of the end portions 15 and 16 of the first connecting member 12 has a second wall 19 which is generally disposed in spaced opposed relation to the first wall 18. The first and second walls 18 and 19 are formed with a plurality of aligned openings 20 for receiving the fasteners 17 to attach the connecting member 12 to the second structural members 2 and 3.

In the preferred embodiment, the first connecting member 12 is formed as a substantially rigid member, having a substantially straight central portion 21 as well as the end portions 15 and 16 which are also substantially straight. The end portions 15 and 16 are substantially in alignment and the central portion 21 is offset from the end portions 15 and 16 by pairs of bends 22 and 23 that between the central portion 21 and each of the end portions 15 and 16.

As is shown in FIG. 1A, the connection of the present invention is formed in the following manner. The connection is shown in a building having a a large support beam 1, a pair of opposed purlins 2 and 3, and roof sheathing 24. The purlins 2 and 3 abut opposed sides 4 and 5 of the beam 1. Each purlin 2 or 3 has at least one mounting surface 10 or 11. Generally, this mounting surface 10 or 11 will be a planar side of the structural member 2 or 3 that is disposed vertically. The mounting surfaces 10 and 11 of the purlins 2 and 3 are in general alignment. Each purlin 2 or 3 has an end 7 or 8. These ends 7 and 8 abut the opposed side faces 4 and 5 of the intervening beam 1 that lies between the purlins 2 and 3. Generally, the purlins 2 and 3 will be suspended from the beam by means of hangers 9.

A tunnel 6 is drilled through the beam 1. The tunnel 6 enters and exists from the beam 1 at the opposed side faces 4 and 5 of the beam 1. The openings 13 and 14 for the tunnel 6 preferably lie as close to the mounting surfaces 10 and 11 of the purlins as is possible. The tunnel 6 will generally be of circular cross-section as it is easy to make such a tunnel 6 in a wooden structural member 1 by means of a drill.

A connecting member 12 is inserted through the tunnel 6 in the beam 1. The preferred connecting member 12 is formed from tube steel with a square cross-section. The connecting member 12 is formed with two pairs of offsetting bends 22 and 23 that displace the central portion 21 of the connecting member 12 out of alignment with the end portions 15 and 16 of the connecting member which are in alignment. The offset central portion 21 of the connecting member 12 is long enough to completely pass through the tunnel 6 in the beam 1. Openings 20 are formed in the tube steel to receive the fasteners 17.

The connecting member 12 is then positioned so that each of the aligned end portions 15 and 16 of the connecting member 12 contacts one of the first mounting surfaces 10 or 11 of each purlin 2 or 3. In the preferred embodiment, the end portions 15 and 16 of the tubular connecting member 12 are of square cross section and are made up of four walls. In two opposing walls 18 and 19 of each end portion, a plurality of aligned mounting openings 20 are formed. These mounting openings 20 are designed to receive fasteners 17 that will pass through the end portions 15 and 16 of the connecting member 12 and attach the connecting member 12 to the purlins 2 and 3. The size of the aligned mounting openings 20 will depend on the size of fasteners 17 used.

Figure 2:
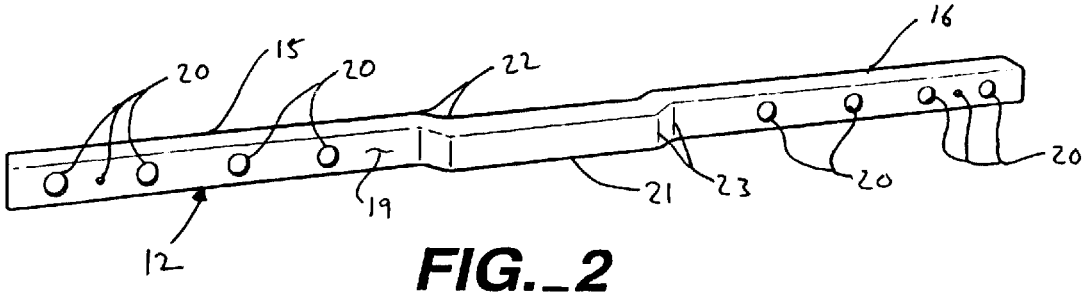
FIG. 2 is an orthogonal view of the connecting member of the present invention.

As shown in FIG. 2, in the preferred embodiment, each end portion 15 or 16 is formed with five mounting openings 20, four large and one small. The four large mounting openings 20 receive bolts 17, and the smaller mounting opening 20 can receive a smaller fastener 17 for temporarily holding the connecting member 12, during the installation process. This smaller fastener can be a large nail or a threaded fastener that does not require a pre-drilled bore.

When bolts 17 are used, apertures will need to be formed in the structural members to receive the bolts 17.

As is shown in FIG. 6, preferably, two connecting members 12 and 12' are used to make each connection between the structural members 2 and 3. The connecting members 12 and 12' share the same bolts 17 that attach the connecting members 12 and 12' to the structural members 2 and 3.

In such a connection, the first structural member 1 also has a second tunnel 6' that has openings 13' and 14' in said opposing side faces 4 and 5, and the second structural members 2 and 3 each has a second mounting surface 10' or 11'. The second mounting surfaces 10' and 11' are in general alignment. A second one-piece connecting member 12' is received by said tunnel 6' and passes through the first structural member 1. The second connecting member 12' also has end portions 15' and 16' that lie against the second mounting surfaces 10' and 11' and are attached to the second structural members 2 and 3 by means of fasteners 17.

Preferably, as is also shown in FIG. 6, the main fasteners 17 for connecting the first and second connecting members 12 and 12' to the second structural members 2 and 3 are bolts 17 that pass all the way through the second structural members 2 and 3 and through each of the connecting members 12 and 12'. The bolts 17 preferably have hexagonal heads 24 and a nut 25 is secured to their threaded ends of the bolts 17 to complete the attachment.

The preferred connecting member is formed from a strong and durable material such as structural tube steel.

I claim:

1. In a building, a connection comprising:

a. a first structural member having a pair of opposing side faces, said first structural member also having a tunnel through said first structural member that has openings in said opposing side faces;

b. a pair of second structural members, each of said pair of second structural members having an end substantially in abutment with one of said opposing side faces of said first structural member, and each of said pair of second structural members also having a first mounting surface, wherein said first mounting surfaces of said second structural members are in general alignment;

c. a first one-piece connecting member that is received by said tunnel through said first structural member, said connecting member having end portions that lie against said mounting surfaces of said second structural members, said end portions having a plurality of fastener openings; and d. fasteners passing through said plurality of fastener openings into said pair of second structural members and attaching said end portions of said connecting member to said second structural members.

2. The connection of claim 1, wherein:

said first one-piece connecting member is formed as an elongated tube.

3. The connection of claim 2, wherein:

said first one-piece connecting member has a substantially polygonal cross-section.

4. The connection of claim 1, wherein:

each of said end portions of said first one-piece connecting member has a first wall, and said first walls of said end portions are in general alignment and are formed so as to substantially register with said first mounting surfaces of said second structural members.

5. The connection of claim 1, wherein:

each of said end portions of said first one-piece connecting member has a second wall, generally disposed in spaced opposed relation to said first wall, and said first and second walls are formed with a plurality of aligned openings for receiving said fasteners to attach said first connecting member to said second structural members.

6. The connection of claim 1, wherein:

said first and second structural members are part of a roof of said building.

7. The connection of claim 1, wherein:

said first connecting member is formed as a substantially rigid member, having a substantially straight central portion as well as said end portions which are also substantially straight, and wherein said end portions are substantially in alignment and said central portion is offset from said end portions by bends between said central portion and each of said end portions.

8. The connection of claim 1, wherein:

a. said first structural member also has a second tunnel that has openings in said opposing side faces;

b. each of said pair of second structural members also has a second mounting surface and said second mounting surfaces of said second structural members are in general alignment, and said connection further comprises;

c. a second one-piece connecting member that is received by said second tunnel through said first structural member, said second connecting member having end portions that lie against said second mounting surfaces of said second structural members; and d. fasteners attaching said end portions of said second connecting member to said second structural members.

9. The connection of claim 8, wherein:

at least some of said fasteners that connect said first and second connecting members to said second structural members pass through one of said second structural members, connecting both said first and second connecting members to one of said second structural members.

10. The connection of claim 3, wherein:

a. said first structural member is a beam, and b. said second structural members are purlins.

11. The connection of claim 4, wherein:

a. said first structural member is a beam, and b. said second structural members are purlins.

12. The connection of claim 5, wherein:

a. said first structural member is a beam, and b. said second structural members are purlins.

13. The connection of claim 6, wherein:

a. said first structural member is a beam, and b. said second structural members are purlins.

14. The connection of claim 2, wherein:

a. said first structural member is a beam, and b. said second structural members are purlins.

15. The connection of claim 13, wherein said first one-piece connecting member is formed as an elongated tube.

16. The connection of claim 14, wherein said first connecting member is formed as a substantially rigid member, having a substantially straight central portion as well as said end portions which are also substantially straight, and wherein said end portions are substantially in alignment and said central portion is offset from said end portions by bends between said central portion and each of said end portions.

17. The connection of claim 16, wherein said first one-piece connecting member has a substantially polygonal cross-section.

18. The connection of claim 17, wherein:

a. each of said end portions of said first one-piece connecting member has a first wall, and said first walls of said end portions are in general alignment and are formed so as to substantially register with said first mounting surfaces of said second structural members;

b. each of said end portions of said first one-piece connecting member has a second wall, generally disposed in spaced opposed relation to said first wall, and said first and second walls are formed with a plurality of aligned openings for receiving said fasteners to attach said first connecting member to said second structural members.

19. The connection of claim 16, wherein:

a. said first structural member also has a second tunnel that has openings in said opposing side faces;

b. each of said pair of second structural members also has a second mounting surface and said second mounting surfaces of said second structural members are in general alignment, and said connection further comprises;

c. a second one-piece connecting member that is received by said second tunnel through said first structural member, said second connecting member having end portions that lie against said second mounting surfaces of said second structural members;

d. fasteners attaching said end portions of said second connecting member to said second structural members; and e. at least some of said fasteners that connect said first and second connecting members to said second structural members pass through one of said second structural members, connecting both said first and second connecting members to one of said second structural members.

20. The connection of claim 13, wherein:

a. said first structural member also has a second tunnel that has openings in said opposing side faces;

b. each of said pair of second structural members also has a second mounting surface and said second mounting surfaces of said second structural members are in general alignment, and said connection further comprises;

c. a second one-piece connecting member that is received by said second tunnel through said first structural member, said second connecting member having end portions that lie against said second mounting surfaces of said second structural members; and d. fasteners attaching said end portions of said second connecting member to said second structural members.

* * * * *

UNITED STATES PATENT AND TRADEMARK OFFICE

CERTIFICATE OF CORRECTION

PATENT NO. : 6,862,854 B1
APPLICATION NO. : 09/638453
DATED : March 8, 2005
INVENTOR(S) : Thomas J. Fitzmyers It is certified that error appears in the above-identified patent and that said Letters Patent is hereby corrected as shown below:

On the Title page

Column 1 Item (12) Change “Fitzmyers.” to --Fitzmyers et al.--

Column 1 Item (75) Inventor: add --William F. Leek, Carmel CA (US)--

Signed and Sealed this

Thirty-first Day of March, 2009

John Doll

JOHN DOLL
*Acting Director of the United States Patent and Trademark Office*